United States Patent [19]

Tarquinio

[11] Patent Number: 4,522,406

[45] Date of Patent: Jun. 11, 1985

[54] GOLF PRACTICE GAME

[76] Inventor: William R. Tarquinio, 1312 Great Oak Dr., Pittsburgh, Pa. 15220

[21] Appl. No.: 536,615

[22] Filed: Sep. 28, 1983

[51] Int. Cl.[3] ..... A63B 69/36

[52] U.S. Cl. ..... 273/197 A; 273/198; 273/195 A

[58] Field of Search ..... 273/32 E, 200 B, 195 A, 273/193 R, 200 R, 197 R, 197 A, 198

[56] References Cited

U.S. PATENT DOCUMENTS

| | | | |
|---|---|---|---|
| 2,262,298 | 11/1941 | Procter | 273/32 E X |
| 3,345,073 | 10/1967 | Hoffman | 273/200 B X |
| 3,827,696 | 8/1974 | Schafer | 273/200 R X |
| 3,869,127 | 3/1975 | Kohori | 273/195 A X |
| 4,130,283 | 12/1978 | Lindquist | 273/195 A |
| 4,311,312 | 1/1982 | O'Brien | 273/195 A |
| 4,432,552 | 2/1984 | Saverino | 273/193 R |

*Primary Examiner*—George J. Marlo
*Attorney, Agent, or Firm*—William J. Ruano

[57] ABSTRACT

A golf practice game which is particularly suitable for indoor use, for developing skills in the game of golf. It comprises a stand of adjustable height on which is mounted an artificial or synthetic turf or rug on which balls may be hit. The artificial turf is mounted on a rectangular table supported solely by a centrally located post which is vertically adjustable in length, to vary the height of the table. The artificial turf includes strips of turf which are slideably mounted and returned to their initial positions by rubber bands, after having been forcibly hit by a golf club. Golf clubs with very short handles are used. A second driving position on the rug is a tee on which the golf ball may be set. When using either of these two positions, it is recommended that a light net or room draperies be used to stop the flight of the ball. A third position is one in which the golf ball is suspended by a cord. A fourth position is a propeller mounted on the side of the stand. In each situation, a short golf club is used to hit the ball when mounted as described. When striking the propeller or suspended ball, the speed of the drive can be denoted by the number of rotations of the propeller or suspended ball.

9 Claims, 6 Drawing Figures

GOLF PRACTICE GAME

This invention relates to a golf practice game and, more particularly to one suitable for indoor practice of the game of golf.

An outstanding disadvantage of existing golf practice games is that they require frequent stooping, which is difficult particularly for older persons or those suffering from a back ailment or arthritis.

An object of the present invention is to provide a novel golf practice game that eliminates the necessity of frequent stooping or chasing of a ball after being hit.

A further object of the invention is to provide a novel assembly that tests the player on hitting a golf ball either on the ground, on a tee, or while suspended, or by hitting a propeller to test the strength or power of the stroke of the player.

Another object is to provide a pair of slideable turfs that move when golf balls are hit thereon, thus simulating a divot being made.

Another object is to enable, during each game, to have the balls readily available and, after each game, easily gather the balls.

Figures 1, 2, 3:
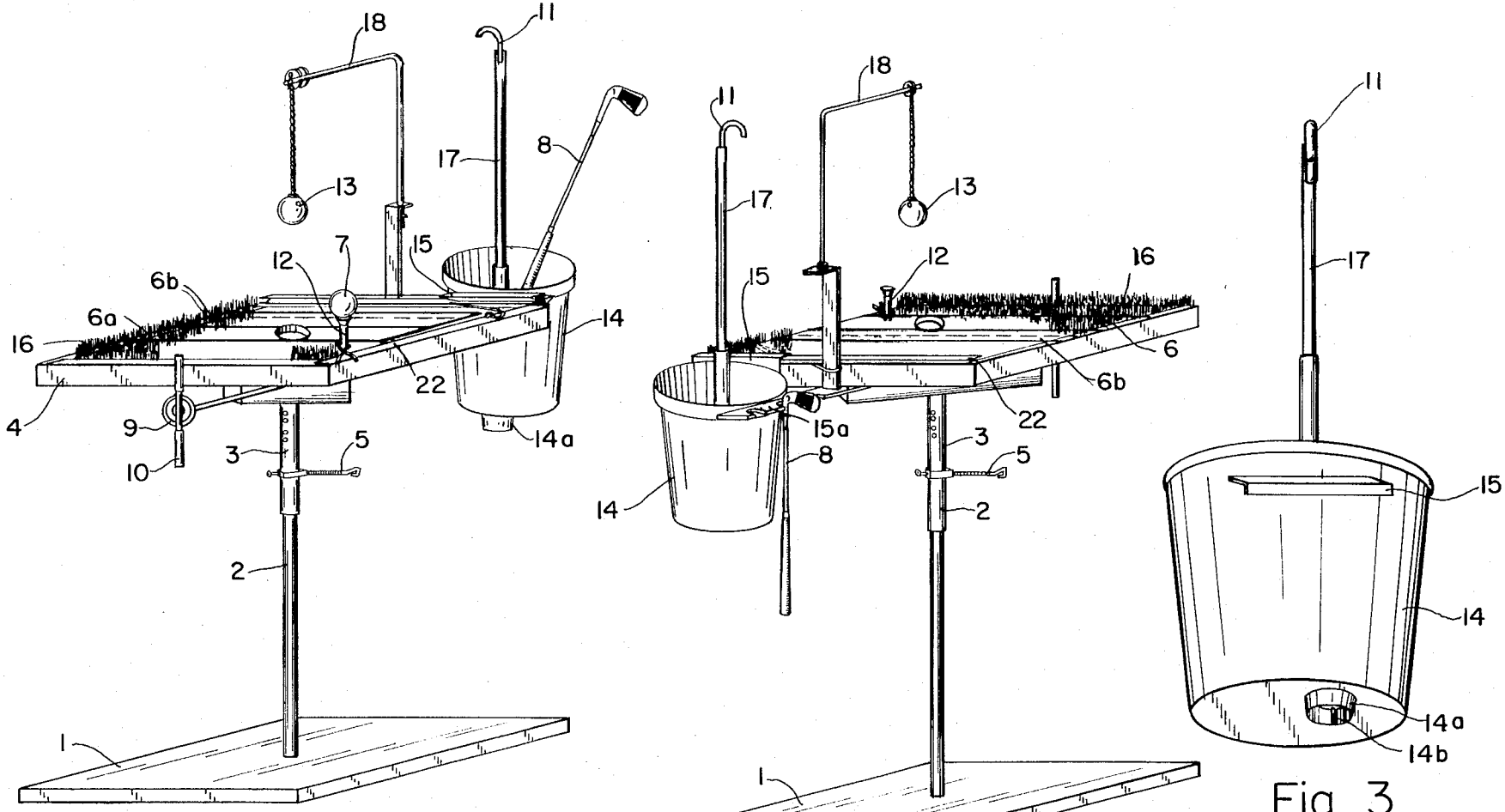
Figure 4:
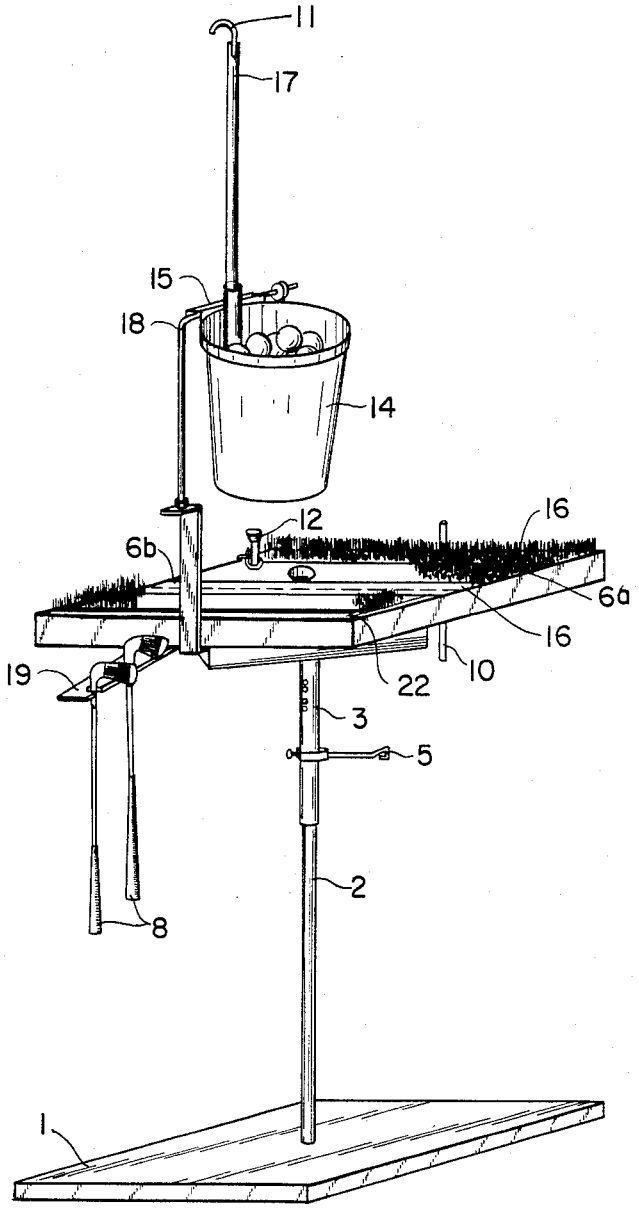

Other objects of the invention will become more apparent from a study of the following description, taken with the accompanying drawing wherein FIG. 1 is a perspective view of a golf stand and assembly embodying the present invention.

Briefly, FIGS. 1 to 6 inclusive show a practice golf device in the form of a table 4 of adjustable height having mounted thereon various items necessary for elderly people that cannot stoop to learn the play of golf, including slidable artificial turf 6*a*, 6*b*, a tee 12, various supporting brackets for shortened golf clubs 8 and golf balls to make the device self contained.

Referring more particularly to FIG. 1 of the drawing, numeral 1 denotes a base and numerals 2 and 3 denote telescoping parts having holes extending diametrically thereto to enable adjustment of height of a table 4 by the mere insertion of a pin 5 through selected registering holes. A thumb screw may be used instead. Movable and returnable artificial turfs 6*a*, 6*b* (shown fragmentary), are mounted on the table 4 centrally of the permanent mounted end strip and a center strip, so that a golf ball 7 may be laid thereon and hit with a very short club 8 to resemble the hitting of a divot. The return action may be obtained by attaching the artificial slideable turfs 6*a*, 6*b*, to table 4 by rubber bands.

A propeller 9 is mounted immediately underneath the table 4 and is provided with a plastic or rubber covering 10 which may be struck by the holf club. If desired, such propeller may have mounted thereon, golf balls (not shown), instead, having diametrically extending holes snugly fitting the end portions of the propeller.

A golf tee 12 is mounted on the table or platform 4 so that driving practice may be conducted for the start of a game on the green.

A further type of practice involves a suspended ball 13 so that by the use of club or an iron, the suspended ball may be hit and the power of the drive will be determined by the number and speed of pivotal rotations of the suspended ball.

A bucket 14 is provided (which can be square or rectangular in shape, instead of round, as shown) with a flanged support element 15 detachably fastened to the top periphery of the bucket, which flange may be selectively hooked onto the side of a table or onto any other nearby object so as to store the golf balls, while the propeller or suspended ball is being struck by a short golf club. A handle 17 is attached to the inside surface of bucket 14 and terminates in a hook 11 to enable the bucket to be supported instead, on the back of a chair or other piece of furniture. Table 4 may have a notched bracket 19 for supporting clubs such as 8, as shown. Said bucket 14 full of balls is attached to the extended bar 18 by means of the flanged support element 15 while one is practicing driving from the tee 12 or the moveable-returnable artificial turf 6*b*.

The bucket has a bottom intake opening surrounded by a cylindrical extension 14*a* of a size somewhat greater than the diameter of the golf ball. A plastic strip 14*b* is provided to form a light fit with the ball so that when a number of balls are contained in the bucket, they will be held in place by each other by friction and by the stop provided by strip 14*b*, so it would be necessary merely to lay the intake opening onto a ball lying on the floor and push the bucket down to pick it up and add it to the balls in the bucket.

Thus, it will be seen that I have provided a versatile golf practice game to give the player a wide variety of practice shots from hitting a ball on the ground, on a tee, or while ball is suspended, or hitting a propeller mounted on the stand; and that I have developed the skills of the player without the necessity of frequent stooping or frequent chasing after a ball that has been hit, making the stand a very practical assembly particularly for indoor use.

Figure 5:
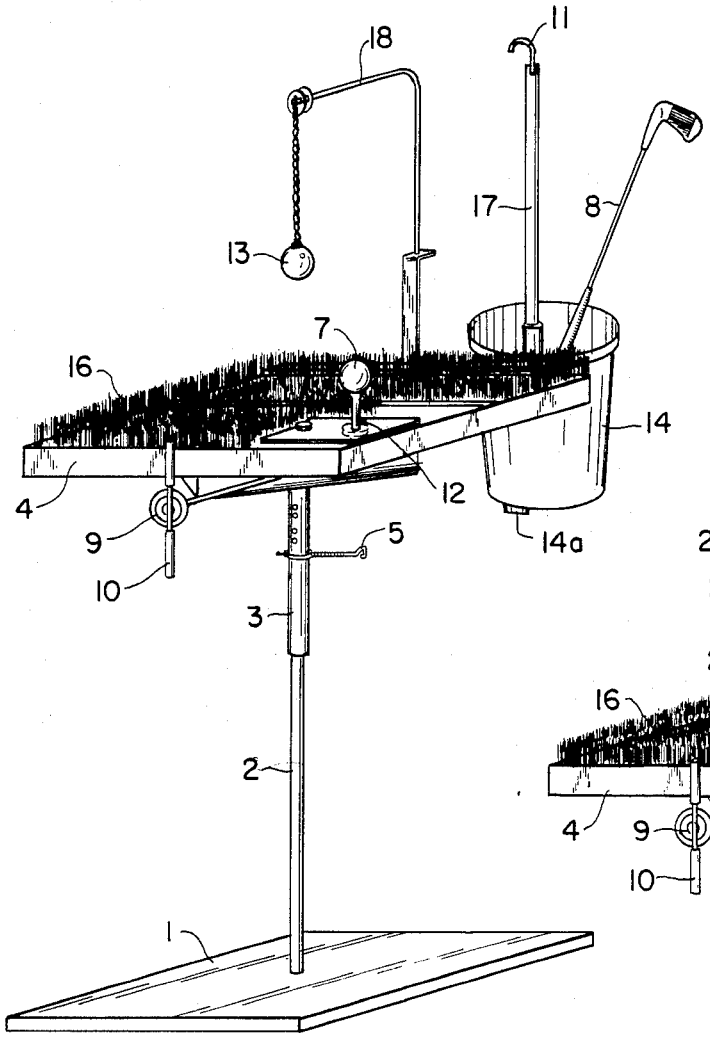
Figure 6:
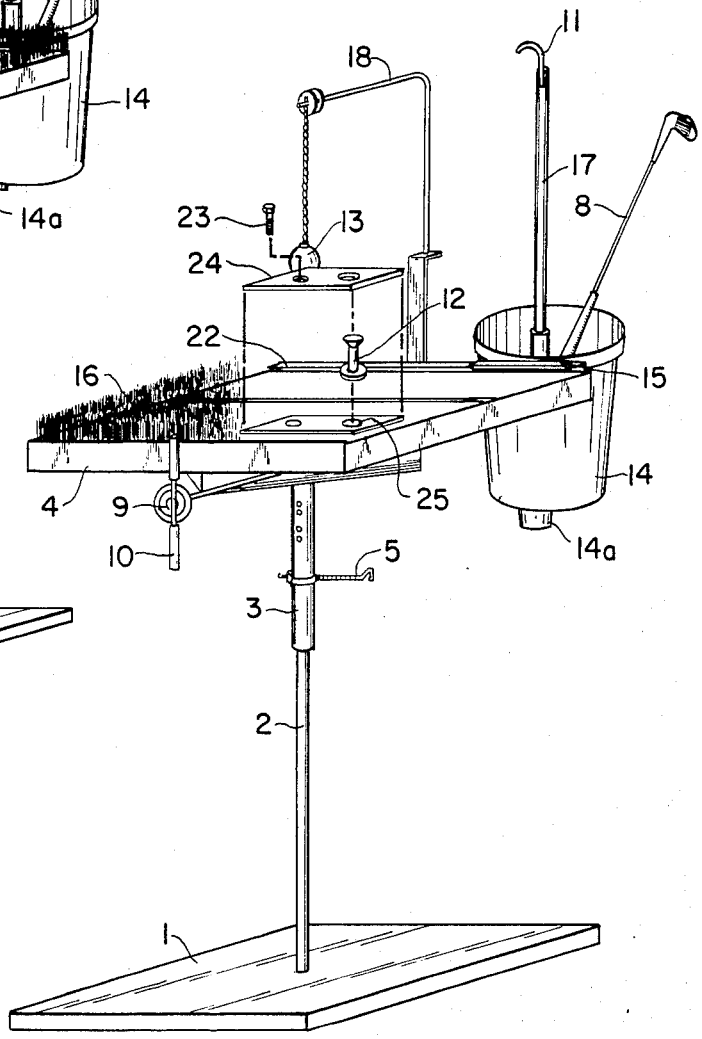

A means of supporting a replaceable tee 12 is shown in FIGS. 5 and 6. It comprises a flexible flap 24 having a hole at one end through which a fastening screw 23 is inserted. The stem of the tee 12 is projected upwardly through hole 25 until the enlarged base acts as a stop, as shown in the exploded view of FIG. 6.

While I have illustrated and described several embodiments of my invention, it will be understood that these are by way of illustration only and that various changes and modifications may be contemplated in my invention and within the scope of the following claims.

I claim:

1. A golf practice game for the elderly comprising a base, a vertical post rigidly mounted on the center of said base, a rectangular table mounted on top of said post, said post constituting the sole supporting means for said table, means on said post for adjusting the height of said table, an artificial turf strip slidably mounted on said table by rubber bands to return it to its initial position after being forcibly struck by a golf club, a golf tee mounted on said table, and means for supporting short golf clubs and means for supporting golf balls, both said means supported by the said table, whereby said golf practice game is self contained.

2. A game as recited in claim 1 together with an inverted L-shaped post mounted on one side of said table and a golf ball suspended by a flexible cord attached to the top extremity of said post.

3. A game as recited in claim 2 wherein said means for supporting golf balls comprises a bucket having a flanged support element attached to its rim for selective attachment to said table or to the horizontal portion of said inverted L-shaped post.

4. A game as recited in claim 3 wherein said bucket has a post extending upwardly from one side thereof terminating in a hook for selective attachment to said table or other support.

5. A game as recited in claim 3 wherein said bucket has a bottom intake opening of a size somewhat greater than the diameter of a golf ball with a strip along the inside of said opening to form a light fit with the ball so that when a number of balls are in the bucket, they will be held in place with each other by friction and by the stop provided by said strip.

6. A game as recited in claim 1 together with flange means on said table for guiding sliding movements of said strip.

7. A game as recited in claim 1 wherein said means for supporting short golf clubs comprises a notched bracket mounted on one side of said table for supporting said short golf clubs.

8. A game as recited in claim 1 together with a flexible tee removably supported on one end of a flexible strip, the other end being attached to said table, whereby the tee may be readily replaced.

9. A game as recited in claim 1 together with a propeller mounted on the side of said table, and a bucket for golf balls having on its brim, means for selectively mounting the bucket on the table.

* * * * *